US009537203B2

(12) United States Patent
Akimoto et al.

(10) Patent No.: US 9,537,203 B2
(45) Date of Patent: Jan. 3, 2017

(54) ANTENNA DEVICE

(71) Applicant: Mitsubishi Electric Corporation, Tokyo (JP)

(72) Inventors: Shimpei Akimoto, Tokyo (JP); Takashi Yanagi, Tokyo (JP); Toru Fukasawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/100,353

(22) PCT Filed: Jan. 23, 2015

(86) PCT No.: PCT/JP2015/051875
§ 371 (c)(1),
(2) Date: May 31, 2016

(87) PCT Pub. No.: WO2015/115333
PCT Pub. Date: Aug. 6, 2015

(65) Prior Publication Data

US 2016/0308273 A1 Oct. 20, 2016

(30) Foreign Application Priority Data

Feb. 3, 2014 (JP) ..... 2014-018449

(51) Int. Cl.
*H01Q 1/10* (2006.01)
*H01Q 1/36* (2006.01)
*H01Q 1/08* (2006.01)

(52) U.S. Cl.
CPC ..... *H01Q 1/364* (2013.01); *H01Q 1/081* (2013.01)

(58) Field of Classification Search
CPC ..... H01Q 1/081; H01Q 1/10; H01Q 1/103; H01Q 1/42; H01Q 1/48
(Continued)

(56) References Cited

U.S. PATENT DOCUMENTS 4,498,086 A * 2/1985 Sandler ..... H01Q 9/16 343/740
6,674,970 B1 * 1/2004 Anderson ..... H01Q 1/366 315/111.21

(Continued)

OTHER PUBLICATIONS

International Search Report—PCT/JP2015/051875 mailed Mar. 10, 2015.

(Continued)

*Primary Examiner* — Dameon E Levi
*Assistant Examiner* — Collin Dawkins
(74) *Attorney, Agent, or Firm* — Studebaker & Brackett PC

(57) ABSTRACT

There is provided a conductive hollow tube (3) which is brought into tight contact with the top surface of a grounding conductor (1*a*) at a position where a first end having an opening plane (4*a*) with an inner diameter matching a diameter of a hole (2*a*) formed on the grounding conductor (1) overlaps with the hole (2*a*), and which is bent so that an opening plane (4*b*) of a second end faces the top surface direction and that an intermediate portion between the first end and the second end is arranged parallel to the grounding conductor (1), and a conductive liquid supplied from the opening plane (4*a*) of the first end is passed through the conductive hollow tube (3) and discharged to the outside from the opening plane (4*b*) of the second end.

5 Claims, 7 Drawing Sheets

(58) Field of Classification Search
USPC ..... 343/902, 709, 719, 872, 705, 848
See application file for complete search history.

(56) References Cited

U.S. PATENT DOCUMENTS 7,898,484 B1 * 3/2011 Tam ..... H01Q 1/364
343/701
8,368,605 B1 * 2/2013 Tam ..... H01Q 1/364
343/701

OTHER PUBLICATIONS

Written Opinion—PCT/JP2015/051875 mailed Mar. 10, 2015.
C. K. Y. Kitamura et al., A Liquid-Metal Reconfigurable Yagi-Uda Monopole Array, 2013 IEEE MTT-S, International Microwave Symposium Digest, 2013, pp. 1-3.
H. Fayad et al., Broadband Liquid Antenna, Electronics Letters, 2006, vol. 42, No. 3, pp. 133-134.
E. Paraschakis, et al., Ionic Liquid Antenna, 2005 IEEE International Workshop on Antenna Technology: Small Antennas and Novel Metamaterials Proceedings, IEEE, 2005, pp. 1-3.

* cited by examiner

ANTENNA DEVICE

TECHNICAL FIELD

The present invention relates to an antenna device which uses a liquid that has electric conductivity (hereinafter, referred to as a conductive liquid) as a radiating element.

BACKGROUND ART

In recent years, antenna devices which use a conductive liquid as a radiating element have been attracting attention.

Since it is possible for a conductive liquid to operate as an antenna in any shape by flowing an electric current through the conductive liquid, a conductive liquid can be used as various types of antennas if an electric power can be fed in an efficient manner.

Conventional methods of feeding power to a conductive liquid include the following method.

Patent Document 1 described below discloses an antenna device in which a conducting wire is wound around a ring-shaped magnetic body and a current is passed through the conducting wire to generate a magnetic flux in the magnetic body. In the antenna device, by linearly ejecting a conductive liquid through a hole provided, in the ring-shaped magnetic body, power is fed to the conductive liquid due to magnetic field coupling.

Note that an operating frequency can be adjusted by controlling the ejection force of the conductive liquid and, accordingly, low-frequency communication can be performed without installing a large-size antenna.

PRIOR ART DOCUMENTS

Patent Documents

Patent Document 1: U.S. patent application Ser. No. 12/539,834

SUMMARY OF THE INVENTION

Problem to be Solved by the Invention

Since a conventional antenna device is configured as described above, a magnetic body is used to feed power to a conductive liquid. However, there is a problem in that radiation efficiency deteriorates due to a significant loss at the magnetic body.

In addition, an unnecessary current flows in a water supply-side of the conductive liquid, and since no means for suppressing the unnecessary current is provided, there is a problem in that loss or an impedance mismatch is created by the unnecessary current on the water supply-side.

The present invention has been made in order to solve the problems described above and an object thereof is to obtain an antenna device which is capable of preventing radiation efficiency from deteriorating and which is capable of suppressing an unnecessary current.

Means for Solving the Problems

An antenna device according to the present invention includes: a grounding conductor on which a hole is formed; a conductive hollow tube which is brought into tight contact with a surface of the grounding conductor at a position where a first end of the conductive hollow tube having an opening plane whose inner diameter matches a diameter of the hole formed on the grounding conductor overlaps with the hole and which is bent so that an opening plane of a second end of the conductive hollow tube on an opposite side to the first end faces an opposite direction to the surface of the grounding conductor and that an intermediate portion between the first end and the second end is arranged parallel to the grounding conductor; and a power feeder line conductor with one end connected to a high-frequency power supply and another end connected to a side surface of the intermediate portion at a position at a distance of ¼ wavelength in an operating frequency from the first end, wherein a conductive liquid supplied from the opening plane of the first end is passed through the conductive hollow tube and discharged to the outside from the opening plane of the second end.

Effect of the Invention

By adopting the configuration described above, the present invention achieves the effects of preventing radiation efficiency from deteriorating and suppressing an unnecessary current.

BEST MODE FOR CARRYING OUT THE INVENTION

Hereinafter, in order to describe the present invention in greater detail, modes for carrying out the present invention will be described with reference to the accompanying drawings.

Embodiment 1

Figure 1:
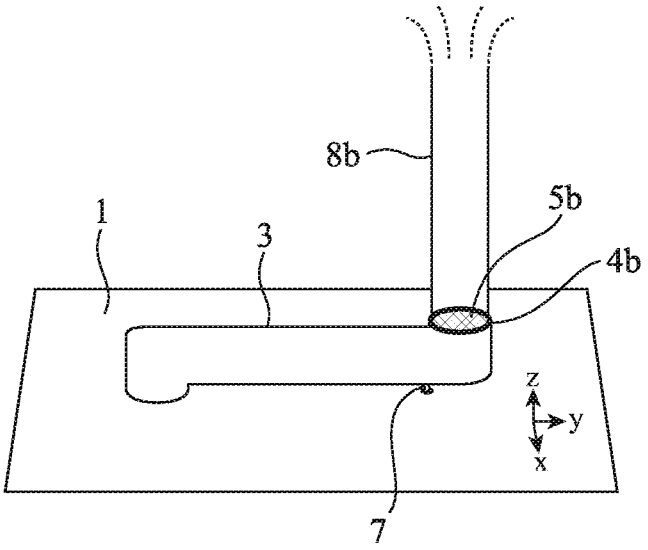
FIG. 1 is a perspective view showing an antenna device according to Embodiment 1 of the present invention.
Figure 2:
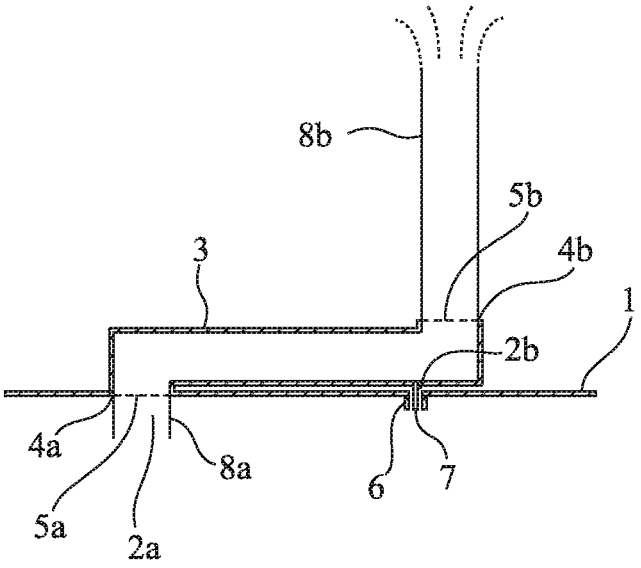
FIG. 2 is a sectional view showing the antenna device according to Embodiment 1 of the present invention.

FIG. 1 is a perspective view showing an antenna device according to Embodiment 1 of the present invention, and FIG. 2 is a sectional view showing the antenna device according to Embodiment 1 of the present invention.

In FIGS. 1 and 2, holes 2*a* and 2*b* are formed on a grounding conductor 1.

A conductive hollow tube 3 is brought into tight contact with a top surface (a front surface) of the grounding conductor 1*a* at the position where a first end thereof (in the diagrams, the left-side end), which has an opening plane 4*a* whose inner diameter matches a diameter of the hole 2*a* formed on the grounding conductor 1, overlaps with the hole 2*a*.

In addition, the conductive hollow tube 3 is bent so that an opening plane 4*b* of a second end (in the diagrams, the right-side end) on an opposite side to the first end faces a top surface direction (an opposite direction to the top surface of the grounding conductor 1) and that an intermediate portion between the first end and the second end is arranged parallel to the grounding conductor 1.

A meshed conductor 5*a* is a conductor arranged so as to cover the opening plane 4*a* of the first end in the conductive hollow tube 3.

A meshed conductor 5*b* is a conductor arranged so as to cover the opening plane 4*b* of the second end in the conductive hollow tube 3.

Mesh coarseness of the meshed conductors 5*a* and 5*b* is desirably selected so as to be coarse enough not to obstruct the flow of conductive liquids 8*a* and 8*b* but sufficiently fine with respect to the wavelength of an operating frequency (a frequency to be used).

A coaxial line outer conductor 6 is a hollow tube conductor which has an inner diameter that matches a diameter of the hole 2*b* of the grounding conductor 1 and which is brought into tight contact with a bottom surface of the grounding conductor 1*a* at a position where one end thereof overlaps with the hole 2*b*.

A coaxial line inner conductor 7 is a conductor having an outer diameter that is smaller than the inner diameter of the coaxial line outer conductor 6 and is arranged to be coaxial with the coaxial line outer conductor 6.

One end of the coaxial line inner conductor 7 is connected to a high-frequency power supply (not shown in drawings) and another end is connected to a side surface of the intermediate portion of the conductive hollow tube 3 at the position at the distance of ¼ wavelength in an operating frequency from the first end of the conductive hollow tube 3.

Note that, a coaxial line structure that is made up of the coaxial line outer conductor 6 and the coaxial line inner conductor 7 constitute a power feeder line conductor.

The conductive liquid 8*a* is a liquid with electric conductivity that is supplied to the inside of the conductive hollow tube 3 through the opening plane 4*a* of the conductive hollow tube 3 from the lower side of the hole 2*a* formed on the grounding conductor 1.

The conductive liquid 8*b* is a liquid with electric conductivity that is ejected to the outside from the opening plane 4*b* of the second end through the inside of the conductive hollow tube 3 and operates as an antenna.

Moreover, the distance between a tip of the conductive liquid 8*b* and the grounding conductor 1 has the height corresponding to ¼ wavelength in the operating frequency.

Next, operations will be described.

When the high-frequency power supply (not shown in drawings) connected to one end of the coaxial line inner conductor 7 generates high-frequency voltage, the coaxial line outer conductor 6 and the coaxial line inner conductor 7 operate as a power feeder line and high-frequency power is supplied via the conductive hollow tube 3 connected to the other end of the coaxial line inner conductor 7 to the conductive liquid 8*b* that operates as an antenna.

In this case, since high-frequency power is not only supplied to the conductive liquid 8*b* that operates as an antenna but is also supplied to the water supply-side conductive liquid 8*a*, antenna performance is adversely affected.

In the antenna device shown in FIGS. 1 and 2, since the conductive hollow tube 3 is shorted to the grounding conductor 1 at the opening plane 4*a* of the first end, a tip-shorted transmission line is formed by the intermediate portion where the conductive hollow tube 3 and the grounding conductor 1 are arranged parallel to each other.

The input impedance $Z_t$ when viewing a short-circuit side (the side of the opening plane 4*a* of the first end) from a supply point of high-frequency power (the point where the coaxial line inner conductor 7 is connected to the conductive hollow tube 3) is expressed by the expression (1) below.

$$Z_t = jZ_0 \tan\{(2\pi/\lambda)L\} \quad (1)$$

$Z_0$: characteristic impedance of transmission line constituted by conductive hollow tube 3 and grounding conductor 1

L: distance between supply point of high-frequency power to short-circuit point

λ: wavelength with respect to operating frequency

As is apparent from expression (1), when the distance L is set to a length around ¼ wavelength, the input impedance $Z_t$ when the short-circuit side is viewed from the supply point of high-frequency power becomes infinitely large.

In the antenna device shown in FIGS. 1 and 2, since the connection position of the coaxial line inner conductor 7 and the conductive hollow tube 3 (the supply point of high-frequency power) is the position at the distance of ¼ wavelength from the first end of the conductive hollow tube 3 (the short-circuit point), the input impedance $Z_t$ when the short-circuit side is viewed from the supply point of high-frequency power becomes infinitely large and high-frequency power is not supplied to the short-circuit side. Therefore, consumption of high-frequency power by the water supply-side conductive liquid 8*a* can be suppressed.

Figure 3:
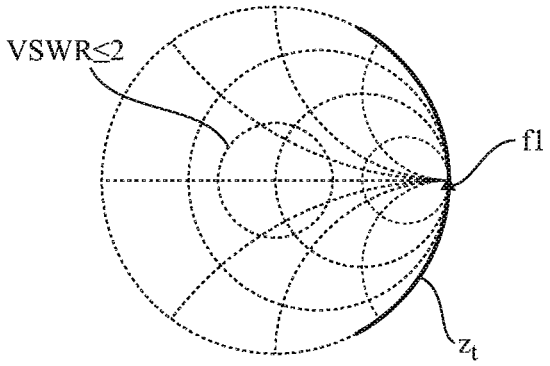
FIG. 3 is an explanatory diagram showing, as a Smith chart, frequency dependence of an input impedance $Z_t$ when viewing a short-circuit side from a supply point of high-frequency power.

FIG. 3 is an explanatory diagram showing, as a Smith chart, frequency dependence of the input impedance $Z_t$ when viewing the short-circuit side from the supply point of high-frequency power.

In FIG. 3, circles and arcs depicted by thin solid lines are lines representing a Smith chart, a bold solid line represents a characteristic curve of the input impedance $Z_t$, and f1 denotes a frequency corresponding to a desired operating frequency.

In the following numerical calculations, sea water is adopted as an example of the conductive liquids 8*a* and 8*b*, and relative permittivity is assumed to be 81, and conductivity is assumed to be 4 S/m.

FIG. 3 shows that the input impedance $Z_t$ is in an approximately opened state at a desired operating frequency f1. Therefore, an antenna-side impedance is not affected at the operating frequency f1.

Figure 4:
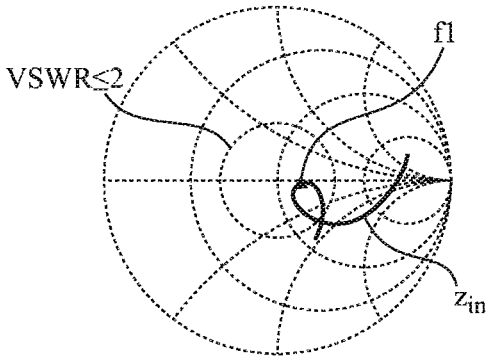
FIG. 4 is an explanatory diagram showing, as a Smith chart, frequency dependence of an input impedance $Z_{in}$ in the antenna device according to Embodiment 1 of the present invention.

FIG. 4 is an explanatory diagram showing, as a Smith chart, frequency dependence of an input impedance $Z_{in}$ in the antenna device according to Embodiment 1 of the present invention.

In FIG. 4, a dotted line circle corresponds to the standing wave ratio (voltage standing wave ratio (VSWR))=2 and the inside of the circle represents the range where the standing wave ratio is smaller than 2.

Figure 5:
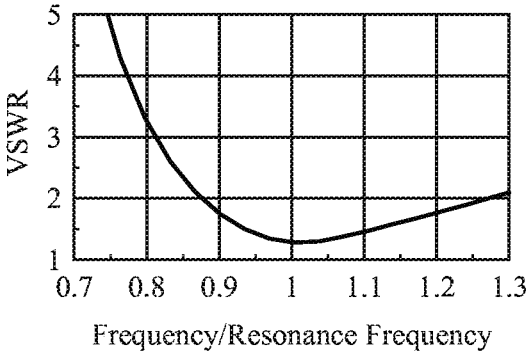
FIG. 5 is an explanatory diagram showing frequency dependence of a standing wave ratio in the antenna device according to Embodiment 1 of the present invention.

FIG. 5 is an explanatory diagram showing frequency dependence of the standing wave ratio in the antenna device according to Embodiment 1 of the present invention. A characteristic curve shown in FIG. 5 corresponds to a characteristic curve shown in FIG. 4.

In FIG. 5, the vertical axis represents frequency normalized by a desired operating frequency and the horizontal axis represents the standing wave ratio VSWR.

FIGS. 4 and 5 show that, with the antenna device according to Embodiment 1, a VSWR of 2 or less at which impedance matching characteristics are conceivably favorable can be obtained at a desired operating frequency.

In this case, since the distance from a tip of the ejected conductive liquid 8*b* to the grounding conductor 1 corresponds to the length of ¼ wavelength in the operating frequency, the conductive liquid 8*b* enters a resonant state and radiates high-frequency waves.

Figure 6:
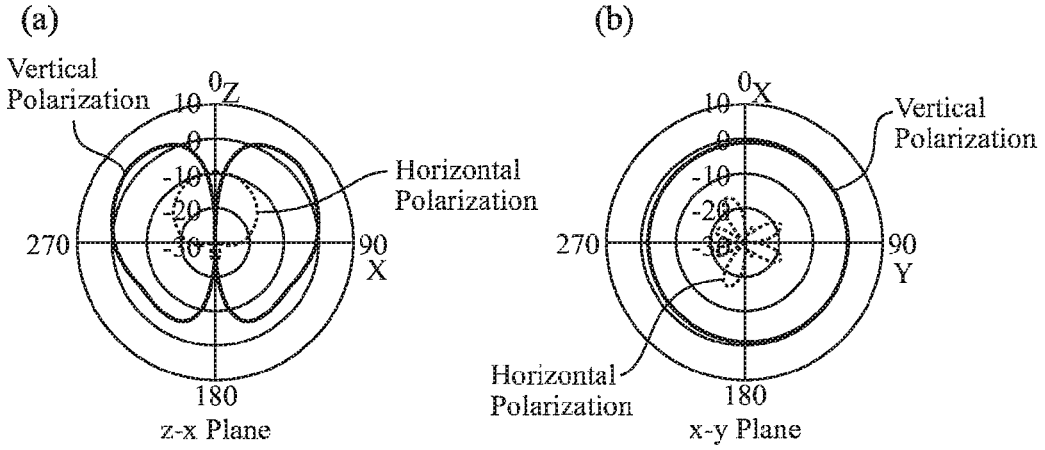
FIG. 6 is an explanatory diagram showing calculation results of radiation patterns on the z-x plane and the x-y plane of xyz coordinates such that the xy plane of the antenna device shown in FIG. 1 constitutes a main surface of a grounding conductor 1.

FIG. 6 is an explanatory diagram showing calculation results of radiation patterns on the z-x plane and the x-y plane of xyz coordinates such that the xy plane of the antenna device shown in FIG. 1 constitutes a main surface of the grounding conductor 1.

Is shown in FIG. 6, the vertical polarization that is the main polarization has an 8-shaped loop pattern on the z-x plane and an approximately nondirectional pattern on the x-y plane.

This indicates that the antenna device is sufficiently operating as a monopole antenna on the grounding conductor 1.

In addition, radiation efficiency is approximately 70% with a loss of 30%. However, as described above, since an unnecessary current to the water supply-side conductive liquid 8*a* is suppressed, most of the loss is due to the ejected conductive liquid 8*b* and the loss at a power feeding section is approximately zero.

As is apparent from the description provided above, by configuring Embodiment 1 so as to include the conductive hollow tube 3 which is brought into tight contact with the top surface of the grounding conductor 1*a* at a position where the first end having the opening plane 4*a* whose inner diameter matches a diameter of the hole 2*a* formed on the grounding conductor 1 overlaps with the hole 2*a*, and which is bent so that the opening plane 4*b* of the second end faces a top surface direction and that the intermediate portion between the first end and the second end is arranged parallel to the grounding conductor 1, wherein a conductive liquid supplied from the opening plane 4*a* of the first end is passed through the conductive hollow tube 3 and discharged to the outside from the opening plane 4*b* of the second end, the effects of preventing radiation efficiency from deteriorating and suppressing an unnecessary current can be achieved.

In other words, according to Embodiment 1, since a loss at a power feeding section can be substantially eliminated by directly supplying high-frequency power to the conductive liquid 8*b*, an effect of suppressing deterioration of radiation efficiency can be achieved. In addition, by shorting the conductive hollow tube 3 at a position apart from the power supply point by around ¼ wavelength to the grounding conductor 1, an effect of suppressing an unnecessary current that flows to the conductive liquid 8*a* can be achieved.

Embodiment 2

Figure 7:
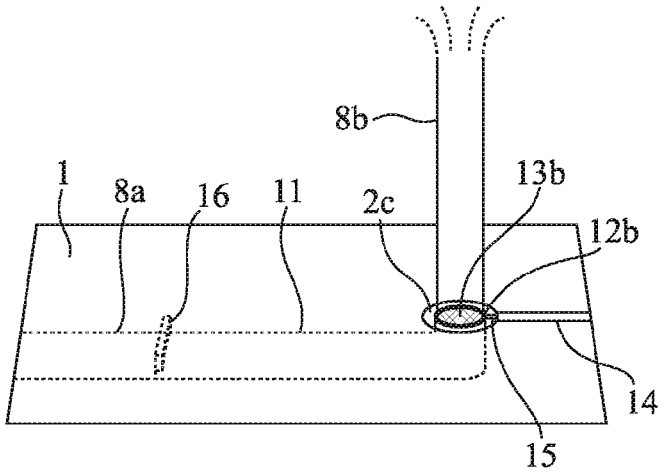
FIG. 7 is a perspective view showing an antenna device according to Embodiment 2 of the present invention.
Figure 8:
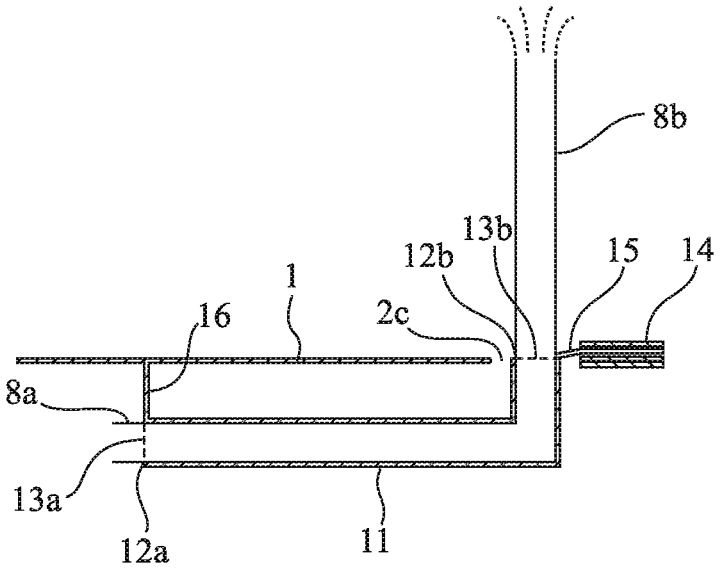
FIG. 8 is a sectional view showing the antenna device according to Embodiment 2 of the present invention.

FIG. 7 is a perspective view showing an antenna device according to Embodiment 2 of the present invention, and FIG. 8 is a sectional view showing the antenna device according to Embodiment 2 of the present invention.

In FIGS. 7 and 8, since same reference numerals as in FIGS. 1 and 2 denote same or corresponding portions, descriptions thereof will be omitted.

A hole 2*c* is formed on a grounding conductor 1.

In a conductive hollow tube 11, the distance between a first end (in the diagrams, the left-side end) arranged on the rear surface side of the grounding conductor 1 and a second end (in the diagrams, the right-side end) having an opening plane 12*b* whose outer diameter is smaller than the diameter of the hole 2*c* formed on the grounding conductor 1 is the length of ¼ wavelength in an operating frequency.

In addition, the conductive hollow tube 11 is arranged so that the height of the second end is the same as the height of a top surface (a front surface) of the grounding conductor 1 and a central axis of the opening plane 12*b* of the second end is aligned with a central axis of the hole 2*c*, and is bent so that an intermediate portion between the first end and the second end is arranged parallel to the grounding conductor 1.

A meshed conductor 13*a* is a conductor arranged so as to cover an opening plane 12*a* of the first end in the conductive hollow tube 11.

A meshed conductor 13*b* is a conductor arranged so as to cover the opening plane 12*b* of the second end in the conductive hollow tube 11.

Mesh coarseness of the meshed conductors 13*a* and 13*b* is desirably selected so as to be coarse enough not to obstruct the flow of conductive liquids 8*a* and 8*b* but sufficiently fine with respect to the wavelength of an operating frequency.

A coaxial line outer conductor 14 is a hollow tube conductor which is arranged so that a side surface thereof comes into tight contact with the top surface of the grounding conductor 1. In FIGS. 7 and 8 while the coaxial line outer conductor 14 is arranged so that the side surface thereof comes into tight contact with the top surface of the grounding conductor 1, the coaxial line outer conductor 14 may be arranged so that the side surface thereof comes into tight contact with the bottom surface of the grounding conductor 1.

A coaxial line inner conductor 15 is a columnar conductor having an outer diameter that is smaller than the inner diameter of the coaxial line outer conductor 11 and is arranged to be coaxial with the coaxial line outer conductor 14.

One end of the coaxial line inner conductor 15 is connected to a high-frequency power supply (not shown in drawings) and another end is connected to an outer circumference of the second end of the conductive hollow tube 11.

Moreover, a coaxial line structure that is made up of the coaxial line outer conductor 14 and the coaxial line inner conductor 15 constitute a power feeder line conductor.

One end of a shorting conductor 16 is connected to the grounding conductor 1 and another end is connected to an outer circumference of the first end of the conductive hollow tube 11.

While the shorting conductor 16 is used to make a short-circuit between the grounding conductor 1 and the conductive hollow tube 11, alternatively, the grounding conductor 1 and the conductive hollow tube 11 may be brought into direct contact with each other.

Next, operations will be described.

When the high-frequency power supply (not shown in drawings) connected to one end of the coaxial line inner conductor 15 generates high-frequency voltage, the coaxial line outer conductor 14 and the coaxial line inner conductor 15 operate as a power feeder line and high-frequency power is supplied via the conductive hollow tube 11 connected to the other end of the coaxial line inner conductor 15 to the conductive liquid 8*b* that operates as an antenna.

In this case, since high-frequency power is not only supplied to the conductive liquid 8*b* that operates as an antenna but is also supplied to the water supply-side conductive liquid 8*a*, antenna performance is adversely affected.

In the antenna device shown in FIGS. 7 and 8, since the conductive hollow tube 11 is shorted to the grounding conductor 1 via the shorting conductor 16, a tip-shorted transmission line is formed by a portion where the conductive hollow tube 11 and the grounding conductor 1 are arranged parallel to each other.

In addition, since the distance between the first end of the conductive hollow tube 11 (a short-circuit point with respect to the grounding conductor 1) and the second end of the conductive hollow tube 11 (a supply point of high-frequency power) corresponds to the length of ¼ wavelength in the operating frequency, the input impedance $Z_t$ when the short-circuit side is viewed from the supply point of high-frequency power becomes infinitely large and high-frequency power is not supplied to the short-circuit side. Therefore, consumption of high-frequency power by the water supply-side conductive liquid 8*a* can be suppressed.

In the antenna device shown in FIGS. 7 and 8, in a similar manner to Embodiment 1 described earlier, since the distance from a tip of the conductive liquid 8*b* that is ejected from the opening plane 12*b* of the second end in the conductive hollow tube 11 to the grounding conductor 1 corresponds to the length of ¼ wavelength in the operating frequency, the conductive liquid 8*b* enters a resonant state and radiates high-frequency waves.

In addition, in the antenna device shown in FIGS. 7 and 8, since the conductive hollow tube 11 is arranged on the bottom surface (rear surface) of the grounding conductor 1, unlike in Embodiment 1 described earlier, cross polarization in the top surface direction of the grounding conductor 1 (the horizontal polarization shown in FIG. 6) can be suppressed.

Figure 9:
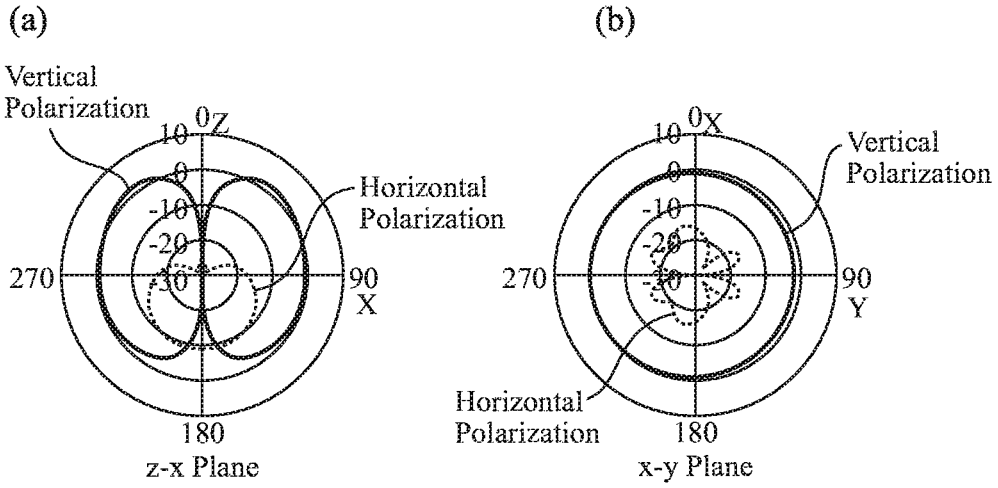
FIG. 9 is an explanatory diagram showing calculation results of radiation patterns on the z-x plane and the x-y plane of xyz coordinates such that the xy plane of the antenna device shown in FIG. 7 constitutes a main surface of a grounding conductor 1.

FIG. 9 is an explanatory diagram showing calculation results of radiation patterns on the z-x plane and the x-y plane of xyz coordinates such that the xy plane of the antenna device shown in FIG. 7 constitutes a main surface of the grounding conductor 1.

As shown in FIG. 9, the vertical polarization that is the main polarization has an 8-shaped loop pattern on the z-x plane and an approximately nondirectional pattern on the x-y plane.

From FIG. 9, it can be recognized that the horizontal polarization in the top surface direction of the grounding conductor 1 is suppressed.

As is apparent from the description provided above, according to Embodiment 2, in addition to achieving similar effects to Embodiment 1, since the conductive hollow tube 11 is arranged on the bottom surface (rear surface) of the grounding conductor 1, an effect of suppressing cross polarization in the top surface direction of the grounding conductor 1 can be achieved.

Embodiment 3

Figure 10:
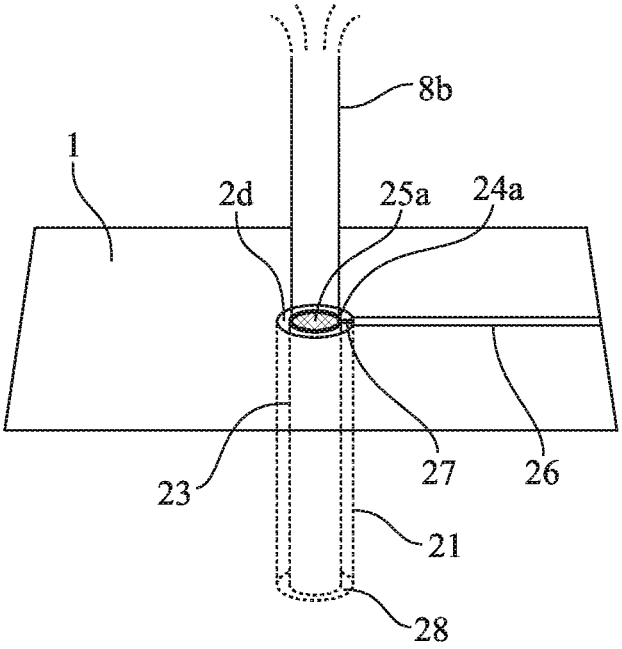
FIG. 10 is a perspective view showing an antenna device according to Embodiment 3 of the present invention.
Figure 11:
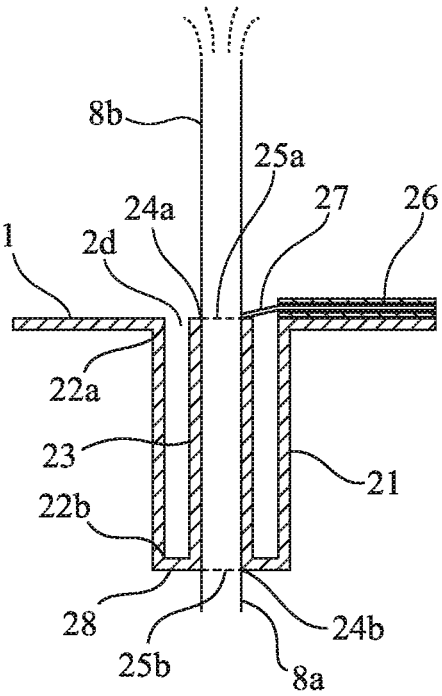
FIG. 11 is a sectional view showing the antenna device according to Embodiment 3 of the present invention.

FIG. 10 is a perspective view showing an antenna device according to Embodiment 3 of the present invention, and FIG. 11 is a sectional view showing the antenna device according to Embodiment 3 of the present invention.

In FIGS. 10 and 11, since same reference numerals as in FIGS. 1 and 2 denote same or corresponding portions, descriptions thereof will be omitted.

A hole 2*d* is formed on a grounding conductor 1.

In a conductive hollow tube 21 that is a first conductive hollow tube, the distance between a first end (in the diagrams, the upper end) having an opening plane 22*a* whose inner diameter matches a diameter of the hole 2*d* formed on the grounding conductor 1 and a second end (in the diagrams, the lower end) having an opening plane 22*b* with an inner diameter matching a diameter of the hole 2*d* is the length of ¼ wavelength in an operating frequency.

In addition, the conductive hollow tube 21 is arranged perpendicular to the grounding conductor 1 so as to come into tight contact with the bottom surface (rear surface) of the grounding conductor 1 at a position where the first end overlaps with the hole 2*d*.

In a conductive hollow tube 23 that is a second conductive hollow tube, the distance between a first end having an opening plane 24*a* with an outer diameter that is smaller than an inner diameter of the conductive hollow tube 21 and a second end having an opening plane 24*b* with an outer diameter that is smaller than an inner diameter of the conductive hollow tube 21 is the length of ¼ wavelength in the operating frequency.

In addition, the conductive hollow tube 23 is arranged to be coaxial with the conductive hollow tube 21 so that the height of the first end is the same as the height of the top surface (the front surface) of the grounding conductor 1.

A meshed conductor 25*a* is a conductor arranged so as to cover the opening plane 24*a* of the first end in the conductive hollow tube 23.

A meshed conductor 25*b* is a conductor arranged so as to cover the opening plane 24*b* of the second end in the conductive hollow tube 23.

Mesh coarseness of the meshed conductors 25*a* and 25*b* is desirably selected so as to be coarse enough not to obstruct the flow of conductive liquids 8*a* and 8*b* but sufficiently fine with respect to the wavelength of an operating frequency.

A coaxial line outer conductor 26 is a hollow tube conductor which is arranged so that a side surface thereof comes into tight contact with the top surface of the grounding conductor 1. In FIGS. 10 and 11, while the coaxial line outer conductor 26 is arranged so that the side surface thereof comes into tight contact with the top surface of the grounding conductor 1, the coaxial line outer conductor 26 may be arranged so that the side surface thereof comes into tight contact with a bottom surface of the grounding conductor 1.

A coaxial line inner conductor 27 is a columnar conductor having an outer diameter that is smaller than the inner diameter of the coaxial line outer conductor 26 and is arranged to be coaxial with the coaxial line outer conductor 26.

One end of the coaxial line inner conductor 27 is connected to a high-frequency power supply (not shown in drawings) and another end is connected to an outer circumference of the first end of the conductive hollow tube 23.

Moreover, a coaxial line structure that is made up of the coaxial line outer conductor 26 and the coaxial line inner conductor 27 constitute a power feeder line conductor.

A shorting conductor 28 is a conductor which shorts the second end of the conductive hollow tube 21 and the second end of the conductive hollow tube 23 to each other.

Next, operations will be described.

When the high-frequency power supply (not shown in drawings) connected to one end of the coaxial line inner conductor 27 generates high-frequency voltage, the coaxial line outer conductor 26 and the coaxial line inner conductor 27 operate as a power feeder line and high-frequency power is supplied via the conductive hollow tube 23 connected to the other end of the coaxial line inner conductor 27 to the conductive liquid 8*b* that operates as an antenna.

In this case, since high-frequency power is not only supplied to the conductive liquid 8*b* that operates as an antenna but is also supplied to the water supply-side conductive liquid 8*a*, antenna performance is adversely affected.

In the antenna device shown in FIGS. 10 and 11, since the first end of the conductive hollow tube 21 is electrically connected to the grounding conductor 1 and the second end of the conductive hollow tube 21 and the second end of the conductive hollow tube 23 are shorted to each other by the shorting conductor 28, the conductive hollow tube 21 and the conductive hollow tube 23 operate as a coaxial line and the coaxial line constitutes a tip-shorted transmission line.

In addition, since the distance between the first end of the conductive hollow tube 23 (a supply point of high-frequency power) and the second end that is a tip of the conductive hollow tube 23 (a short-circuit point) corresponds to the length of ¼ wavelength in the operating frequency, the input impedance $Z_t$ when the short-circuit side is viewed from the supply point of high-frequency power becomes infinitely large and high-frequency power is not supplied to the short-circuit side. Therefore, consumption of high-frequency power by the water supply-side conductive liquid 8*a* can be suppressed.

Furthermore, since the conductive hollow tube 21 and the conductive hollow tube 23 operate as a coaxial line, matching can be realized, at a desired impedance by changing the diameter of the conductive hollow tube 21 or the conductive hollow tube 23.

Figure 12:
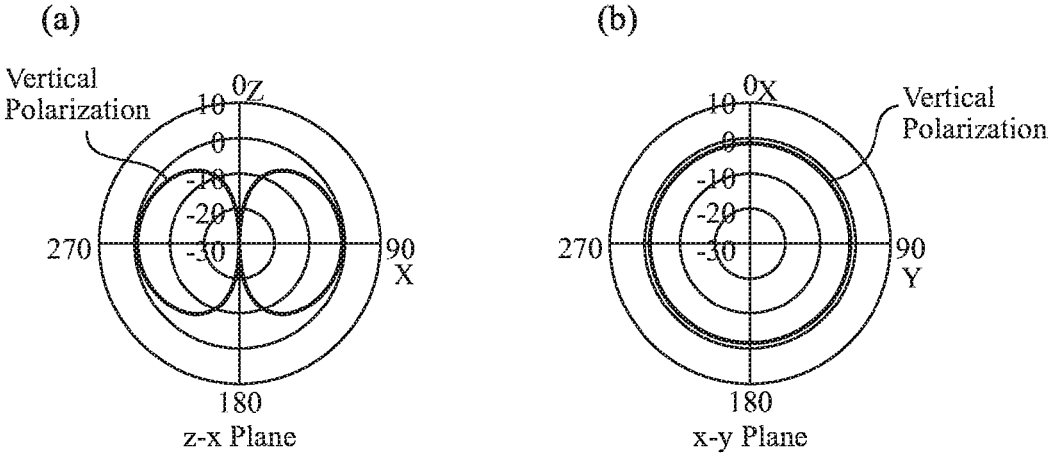
FIG. 12 is an explanatory diagram showing calculation results of radiation patterns on the z-x plane and the x-y plane of xyz coordinates such that the xy plane of the antenna device shown in FIG. 10 constitutes a main surface of a grounding conductor 1.

FIG. 12 is an explanatory diagram showing calculation results of radiation patterns on the z-x plane and the x-y plane of xyz coordinates such that the xy plane of the antenna device shown in FIG. 10 constitutes a main surface of the grounding conductor 1.

As shown in FIG. 12, the vertical polarization, that is the main polarization has an 8-shaped loop pattern on the z-x plane and an approximately nondirectional pattern on the x-y plane.

FIG. 12 shows that the horizontal polarization is 30 dB or less, and it can be recognized that the cross polarization is suppressed in all directions.

As is apparent from the description provided above, according to Embodiment 3, in addition to achieving similar effects to Embodiment 1, since a coaxial line that is made up of the conductive hollow tube 21 and the conductive hollow tube 23 form a tip-shorted transmission line and the length of the coaxial line corresponds to the length of ¼ wavelength in the operating frequency, the following effects can be achieved: it is possible to adjust impedance matching; and the cross polarization that is radiated from the present antenna device can be suppressed in all directions.

Embodiment 4

Figure 13:
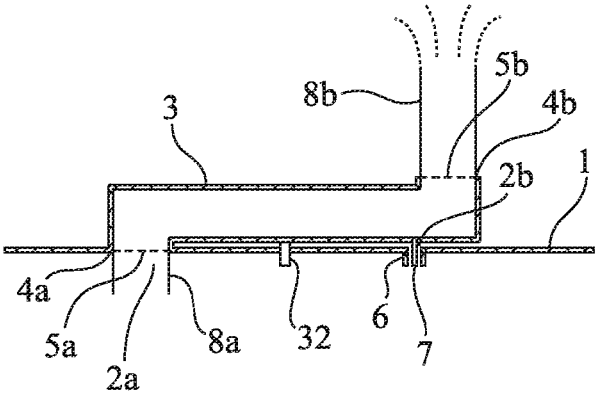
FIG. 13 is a sectional view showing an antenna device according to Embodiment 4 of the present invention.
Figure 14:
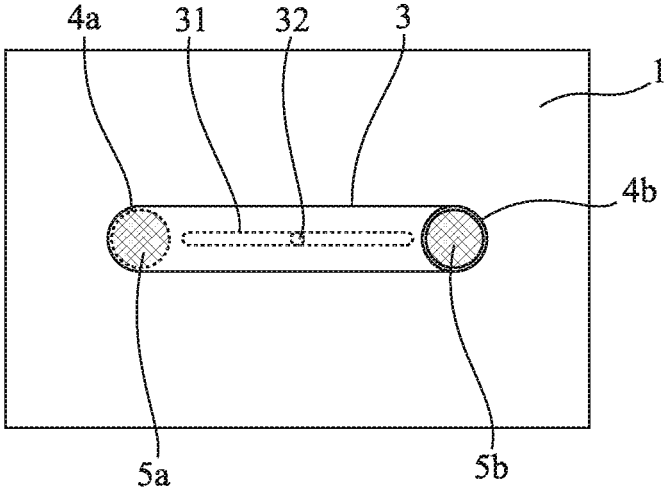
FIG. 14 is a top view showing the antenna device according to Embodiment 4 of the present invention.

FIG. 13 is a perspective view showing an antenna device according to Embodiment 4 of the present invention, and FIG. 14 is a top view showing the antenna device according to Embodiment 4 of the present invention.

In FIGS. 13 and 14, since same reference numerals as in FIGS. 1 and 2 denote same or corresponding portions, descriptions thereof will be omitted.

A slotted hole 31 is a hole having a linearly extending shape formed on a grounding conductor 1 so as to extend along an intermediate portion of a conductive hollow tube 3.

A shorting conductor 32 is a conductor that establishes conduction between the grounding conductor 1 and the conductive hollow tube 3 in a state of being inserted into the slotted hole 31 formed on the grounding conductor 1 and is movable along the slotted hole.

In other words, the shorting conductor 32 is a columnar (or prismatic) conductor with a diameter similar to the hole width of the slotted hole 31 and is arranged so that the grounding conductor 1 and the conductive hollow tube 3 are electrically shorted to each other.

In this Embodiment 4, by adjusting the water amount of a conductive liquid 8*a* that is supplied from the hole 2*a*, the distance between a tip of a conductive liquid 8*b* and the grounding conductor 1 can be controlled to the height of around ¼ wavelength corresponding to a desired operating frequency.

In addition, the conductive hollow tube 3 is shorted to the grounding conductor 1 via the shorting conductor 32 and a tip-shorted transmission line is formed by the intermediate portion where the conductive hollow tube 3 and the grounding conductor 1 are arranged parallel to each other.

In this case, by moving the shorting conductor 32 inside the slotted hole 31, the distance from the supply point of high-frequency power to the short-circuit point of the conductive hollow tube 3 and the grounding conductor 1 (the point at the position of the shorting conductor 32) can be controlled to the length of around ¼ wavelength corresponding to the desired operating frequency.

As is apparent from the description provided above, according to this Embodiment 4, in addition to achieving similar effects to Embodiment 1, by adjusting the position of the shorting conductor 32 while controlling the election momentum of the conductive liquid 8*b*, an effect of obtaining an antenna device with variable operating frequency can be achieved.

Embodiment 5

Figure 15:
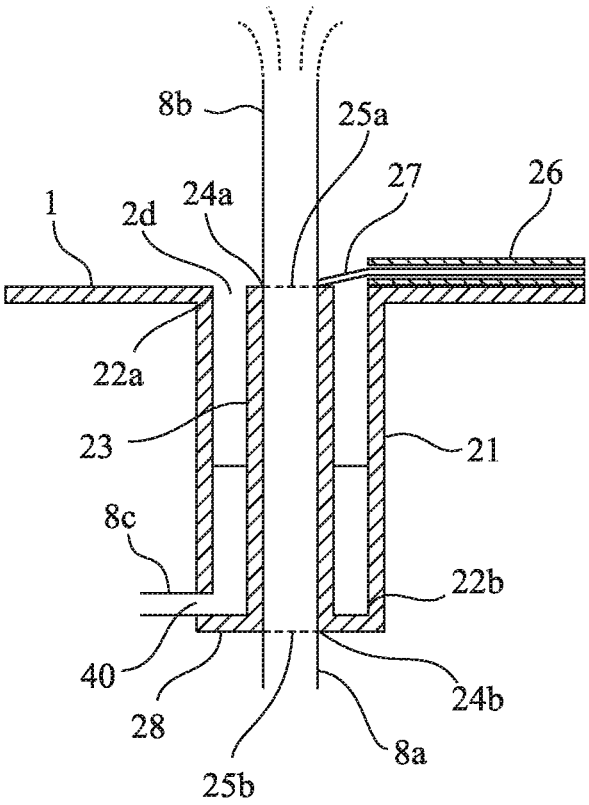
FIG. 15 is a sectional view showing an antenna device according to Embodiment 5 of the present invention.

FIG. 15 is a sectional view showing an antenna device according to Embodiment 5 of the present invention. In FIG. 15, since same reference numerals as in FIG. 11 denote same or corresponding portions, descriptions thereof will be omitted.

A hole 40 is a water supply hole formed at a lower position (on a side of a second end) of a conductive hollow tube 21.

A conductive liquid 8*c* is a second conductive liquid which is supplied from the hole 40 and which is stored inside a coaxial line structure constituted by conductive hollow tubes 21 and 23 and a shorting conductor 23.

In this Embodiment 5, by adjusting the water amount of the conductive liquid 8*a* that is supplied from the opening plane 24*b*, the distance between a tip of the conductive liquid 8*b* and the grounding conductor 1 can be controlled to the height of around ¼ wavelength corresponding to a desired operating frequency.

In addition, since the conductive hollow tube 21 and the conductive hollow tube 23 are shorted to each other at the position of the water surface of the conductive liquid 8*c*, a tip-shorted transmission line is formed.

By adjusting the water amount of the conductive liquid 8*c* that is supplied from the hole 40, the distance between the supply point of high-frequency power and the position of the water surface of the conductive liquid 8*c* (a short-circuit point) can be controlled to around ¼ wavelength corresponding to the desired operating frequency.

As is apparent from the description provided above, according to this Embodiment 5, in addition to achieving similar effects to Embodiment 3, by controlling a force by which the conductive liquid 8*b* is ejected and adjusting the water amount of the conductive liquid 8*c*, an effect of obtaining an antenna device with variable operating frequency can be achieved.

Note that, it is to be understood that the respective embodiments of the present invention may be combined in any way and any component of the respective embodiments of the present invention may be modified or omitted without departing from the spirit and scope of the invention.

INDUSTRIAL APPLICABILITY

Since the antenna device according to the present invention is configured so as to be provided with a conductive hollow tube which includes: a first end having an opening plane whose inner diameter matches a diameter of a hole formed on a grounding conductor and brought into tight contact with a surface of the grounding conductor at a position where the opening plane and the hole overlap with each other; and a second end on an opposite side to the first end and having an opening plane in an opposite direction to the grounding conductor, and which is bent so that an intermediate portion between the first end and the second end becomes parallel to the grounding conductor, wherein a conductive liquid supplied from the opening plane of the first end is passed through the conductive hollow tube and discharged to the outside from the opening plane of the second end, the antenna device is capable of preventing radiation efficiency from deteriorating and suppressing an unnecessary current, and can be preferably used in cases where a conductive liquid is used as a radiating element.

EXPLANATION OF REFERENCE NUMERALS

1 grounding conductor
2*a*, 2*b*, 2*c*, 2*d* hole
3 conductive hollow tube
4*a* opening plane of first end
4*b* opening plane of second end
5*a*, 5*b* meshed conductor
6 coaxial line outer conductor (power feeder line conductor)
7 coaxial line inner conductor (power feeder line conductor)
8*a*, 8*b* conductive liquid
8*c* conductive liquid (second conductive liquid)
11 conductive hollow tube
12*a* opening plane of first end
12*b* opening plane of second end
13*a*, 13*b* meshed conductor
14 coaxial line outer conductor (power feeder line conductor)
15 coaxial line inner conductor (power feeder line conductor)
16 shorting conductor
21 conductive hollow tube (first conductive hollow tube)
22*a* opening plane of first end
22*b* opening plane of second end
23 conductive hollow tube (second conductive hollow tube)
24*a* opening plane of first end
24*b* opening plane of second end
25*a*, 25*b* meshed conductor
26 coaxial line outer conductor (power feeder line conductor)
27 coaxial line inner conductor (power feeder line conductor)
28 shorting conductor
31 slotted hole
32 shorting conductor
40 hole

The invention claimed is:

1. An antenna device comprising:

a grounding conductor on which a hole is formed;

a conductive hollow tube which is brought into tight contact with a surface of the grounding conductor at a position where a first end of the conductive hollow tube having an opening plane whose inner diameter matches a diameter of the hole formed on the grounding conductor overlaps with the hole, and which is bent so that an opening plane of a second end of the conductive hollow tube on an opposite side to the first end faces an opposite direction to the surface of the grounding conductor, and that an intermediate portion between the first end and the second end is arranged parallel to the grounding conductor; and a power feeder line conductor with one end connected to a high-frequency power supply and another end connected to a side surface of the intermediate portion at a position at a distance of ¼ wavelength in an operating frequency from the first end, wherein a conductive liquid supplied from the opening plane of the first end is passed through the conductive hollow tube and discharged to an outside from the opening plane of the second end.

2. The antenna device according to claim 1, further comprising:

a linear slotted hole formed on the grounding conductor so as to extend along the intermediate portion of the conductive hollow tube; and a shorting conductor which establishes conduction between the grounding conductor and the conductive hollow tube in a state of being inserted into the slotted hole which is movable along the slotted hole.

3. An antenna device comprising:

a grounding conductor on which a hole is formed;

a conductive hollow tube in which a distance between a first end arranged on a rear surface side of the grounding conductor and a second end having an opening plane whose outer diameter is smaller than a diameter of the hole formed on the grounding conductor is a length of ¼ wavelength in an operating frequency, the conductive hollow tube being arranged so that a height of the second end is the same as a height of a surface of the grounding conductor and a central axis of the opening plane of the second end is aligned with a central axis of the hole, and being bent so that an intermediate portion between the first end and the second end is arranged parallel to the grounding conductor;

a power feeder line conductor with one end connected to a high-frequency power supply and another end connected to the second end; and a shorting conductor with one end connected to the grounding conductor and another end connected to the first end, wherein a conductive liquid supplied from the opening plane of the first end is passed through the conductive hollow tube and discharged to an outside from the opening plane of the second end.

4. An antenna device comprising:

a grounding conductor on which a hole is formed;

a first conductive hollow tube which is arranged perpendicular to the grounding conductor so as to be brought into tight contact with a rear surface of the grounding conductor at a position where a first end of the first conductive hollow tube having an opening plane whose inner diameter matches a diameter of the hole formed on the grounding conductor overlaps with the hole and which has a length of ¼ wavelength in an operating frequency;

a second conductive hollow tube which has a first end having an opening plane with an outer diameter that is smaller than an inner diameter of the first conductive hollow tube, a height of the first end being the same as a height of the surface of the grounding conductor, which is arranged to be coaxial with the first conductive hollow tube, and which has a length of ¼ wavelength in the operating frequency;

a power feeder line conductor with one end connected to a high-frequency power supply and another end connected to the first end of the second conductive hollow tube; and a shorting conductor which shorts a second end of the first conductive hollow tube on an opposite side to the first end thereof and a second end of the second conductive hollow tube on an opposite side thereof to the first end to each other, wherein a conductive liquid supplied from the opening plane of the second end of the second conductive hollow tube is passed through the second conductive hollow tube and discharged to an outside from the opening plane of the first end of the second conductive hollow tube.

5. The antenna device according to claim 4, wherein a water supply hole is formed on a side of the second end of the first conductive hollow tube, and a second conductive liquid is supplied from the water supply hole.

* * * * *